United States Patent [19]

Brawley

[11] 3,988,861

[45] Nov. 2, 1976

[54] LAPPING OR GRINDING APPARATUS AND METHOD

[76] Inventor: Thomas Scott Brawley, 15 Dogwood Court, Cromwell, Conn. 06416

[22] Filed: July 16, 1975

[21] Appl. No.: 596,566

Related U.S. Application Data

[63] Continuation-in-part of Ser. No. 387,498, Aug. 10, 1973, Pat. No. 3,913,275.

[52] U.S. Cl. ..... 51/3; 51/136; 51/289 R

[51] Int. Cl.[2] ..... B24B 5/20

[58] Field of Search ..... 51/3, 59 R, 61, 135, 51/136, 137, 289 R, 289 S

[56] References Cited

UNITED STATES PATENTS

| | | | |
|---|---|---|---|
| 1,486,344 | 3/1924 | Hoke | 51/289 R |
| 1,719,964 | 7/1929 | Bruhl | 51/61 |
| 1,843,979 | 2/1932 | Hoke | 51/289 R |
| 1,932,092 | 10/1933 | Hijo | 51/137 |
| 2,012,555 | 8/1935 | Walker | 51/59 R |

*Primary Examiner*—Harold D. Whitehead
*Attorney, Agent, or Firm*—DeLio and Montgomery

[57] ABSTRACT

Apparatus for conditioning (i.e., lapping, pressure grinding or flash rolling) the surfaces of anti-friction rolling elements such as cylindrical rollers, needle rollers, barrel rollers or spherical rolling elements which comprises relatively movable plates complementarily channeled to provide tracks for passage between said plates of the elements to be conditioned, means for applying high uniform or variable pressure through said plates to said elements, means for applying abrasive material to the elements being conditioned, and means for actuating the plates, according to their design, for reciprocating movement to condition a low quality batch of elements or for continuous one-way movement to act on a succession of elements which may be recycled as required to achieve the desired result of high quality anti-friction rolling elements. Also the method of effecting the conditioning of such elements by the means described or equivalents thereof.

10 Claims, 13 Drawing Figures

LAPPING OR GRINDING APPARATUS AND METHOD

This is a continuation-in-part of application Ser. No. 387,498, filed Aug. 10, 1973, now U.S. Pat. No. 3,913,275.

The present lapping, pressure grinding or flash roll apparatus comprises basically two or more parallel plates profiled or channeled to provide facing tracks having cross-sections which are slightly larger than the desired cross-sections of the rolling elements to be lapped, pressure ground or flash rolled. The plates are relatively movable, in the line of the tracks, and the rolling elements to be lapped, pressure ground or flash rolled are placed transversely in the tracks, supplied with a suitable abrasive material, and rolled under heavy pressure. When the relative motion is reciprocatory, a low quality batch of elements can be rolled back and forth within the limits of travel of the plates until the desired surface and/or size condition has been achieved, whereupon the finished batch is ejected and another batch supplied. In machines where a continuous series of plates move only in one direction past a stationary plate, the rolling elements will traverse the length of the latter and be discharged, for re-cycling to the inlet end and through the machine as many times as needed, preferably in a random manner.

It is normally convenient to have a bottom plate stationary and strongly supported while an upper plate, whether longitudinally movable or not, can be subjected to controlled heavy downward pressure. As one practical alternative, upward pressure may be applied to a stationary bottom plate while the movable upper plate rests against back-up rollers. The pressure exerted upon the exterior surfaces of the parallel lapping, pressure grinding or flash roll plates may be spread equally over these exterior surfaces or may vary progressively or otherwise. The pressure will be transmitted to the parallel contact surfaces where rolling elements and plates roll or oscillate. The pressure from these surfaces combined with the use of abrasives and traversing motion will cause friction between the rolling elements and the parallel lapping, pressure grinding or flash roll plates. This friction will cause a wearing effect or stock removal action to occur equally across the axes of the O.D. surfaces of the rolling elements. Rolling elements whose O.D. dimensions are larger than other rolling elements will gradually be reduced to the same size. Cylindrical rolling elements with taper defects will become taper-free. As this occurs each rolling element will roll substantially the same distance and receive an equal amount of pressure. Each of the grooves of at least one of the plates of the conditioning apparatus is designed so that each of the rolling elements will roll an equal distance per pass. If the abrasive compounds, abrasive mixtures or coolants are of a consistent chemistry each rolling element should therefore contact an equal amount of abrasive or coolant. Each rolling element of that lot will also be processed for an equal amount of time. The result of these factors will assure that any two anti-friction rolling elements processed in the same lot will have precisely identical dimensions.

In the manufacture of anti-friction rolling elements such as cylindrical rollers, needle rollers or barrel rollers the finishing operations normally include the use of expensive vitrified grinding wheels or honing stones, particularly vitrified centerless grinding wheels for determining accurately the critical outside diameter of the rolling elements. Such grinding wheels require dressing by means of expensive diamond dressing tools, and tend to cause grind cuts, flats or re-hardened areas on the rolling elements.

Important objects of the present invention are to:

- eliminate the expense of vitrified grinding wheels or honing stones;
- eliminate the expense of industrial diamonds used to dress centerless grinding wheels;
- make possible the production of rolling elements which are free of grind cuts, grind flats and re-hardened areas, with uniform finishes of 0.5 microinches or better, roundness accuracy within 0.125 microns and size uniformity within 0.25 microns;
- make possible the production of cylindrical rolling elements (including all of the various modifications of this form) and spherical rolling elements through utilization of one process.

Throughout the history of rolling element manufacturing the two types of rolling elements utilized two distincly different methods of manufacture. The present invention makes it possible to produce both products with a superior quality at a reduced cost as related to the former methods of manufacture.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

Practical embodiments of the invention are shown in the accompanying drawings wherein.

Figure 1:
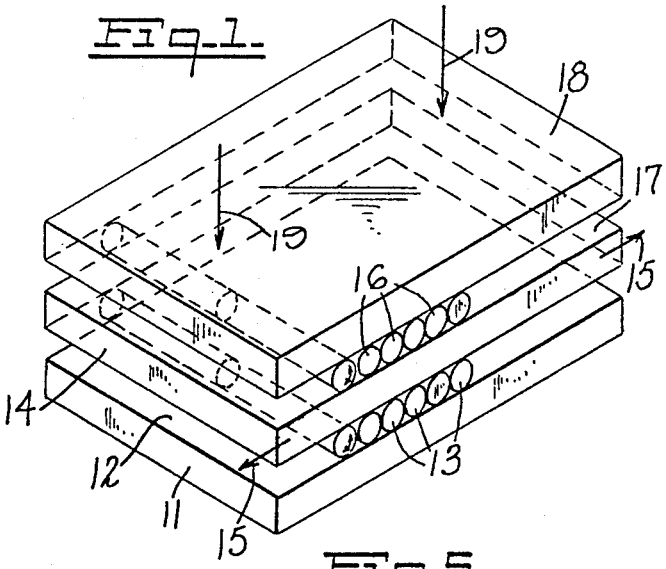
FIG. 1 represents, diagrammatically, a perspective view of the working elements of one form of apparatus.

Referring to the drawings, the principle of the invention is illustrated in FIG. 1 wherein the fixed base plate 11 carries on its upper surface 12 a batch of plain cylindrical rolling elements 13 to be lapped, pressure ground or flash rolled, the rolling elements being arranged in two groups, each extending across the width of the surface 12. An intermediate plate 14 rests on the rolling elements 13 and is adapted to be reciprocated, as indicated by arrows 15, 15, longitudinally by suitable mechanical means (not shown). A second batch of rolling elements 16 rests on the upper surface 17 of the plate 14 and an upper plate 18 rests on the rolling elements 16, the upper plate 18 being subjected to controlled heavy downward pressure (e.g., hydraulic, pneumatic, mechanical or gravity) as indicated by the arrows 19, 19 by suitable means (not shown). Quantities of abrasive lapping or grinding materials are fed into the spaces between the plates and the plate 14 is reciprocated to roll the rolling elements 13, 16 back and forth within limits of travel determined by the length of the plates. The distance of reciprocation may be uniform with each reciprocating movement or may be non-uniform while traversing random distances. The time of treatment will vary depending on the original condition of the rolling element blanks and the degree of perfection required in the finished product, the pressure rolling operation being adapted to correct both surface and dimensional defects and to produce finished rolling elements of uniform size in each batch. Such an operation would be beneficial to round up cylindrical slugs which have become out-of-round from the initial raw material cut-off operation.

Figure 2:
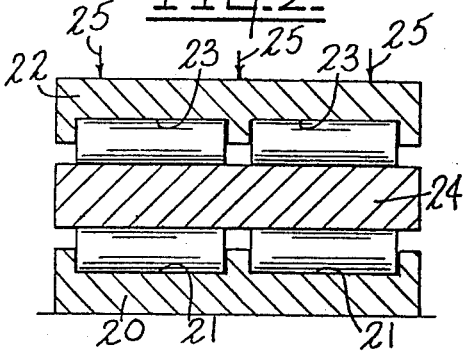
FIG. 2 represents a transverse vertical section of another form of plate and rolling element assembly.

As a practical matter it is advisable to provide at least one plate in each working pair with a channeled profile, to control accurately the position of the rolling elements. The exception to this rule however would be in processing miniature rolling elements where the working life of the plates would be reduced should a channeled profile be used. In FIG. 2 the bottom plate 20 (corresponding to plate 11) has parallel channels 21, 21 in its upper face and the upper plate 22 (corresponding to plate 18) has similar parallel channels 23, 23 in its lower face, the reciprocating plate 24 being flat, like the plate 14 in FIG. 1, and pressure being applied to the assembly, as indicated by the arrows 25.

Figure 3:
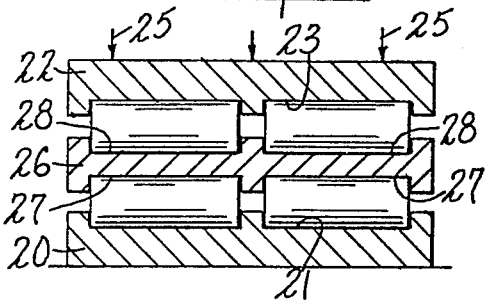
FIG. 3 represents a transverse vertical section of a modified form of the apparatus shown in FIG. 2.

The arrangement shown in FIG. 3 is similar to that of FIG. 2 except that the intermediate reciprocating plate 26 has channels 27, 28 in its lower and upper faces, corresponding to the channels in the lower and upper plates.

Figure 5:
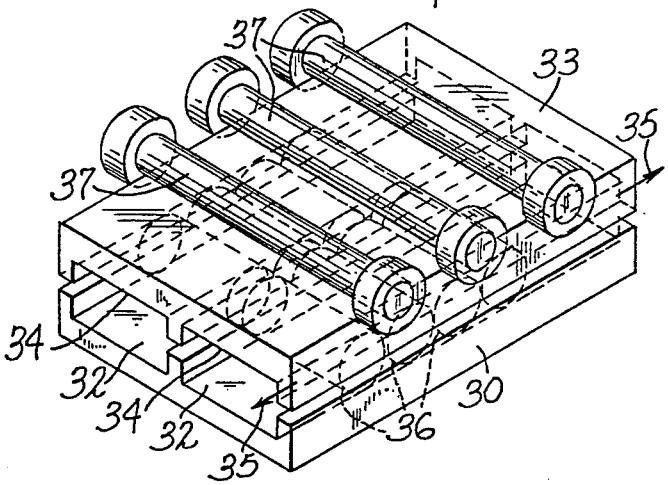
FIG. 5 represents a perspective view of the apparatus in FIG. 4 with the back-up roller support omitted.
Figure 4:
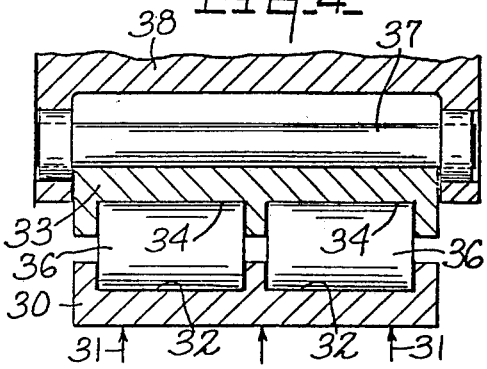
FIG. 4 represents a transverse vertical section of a further modified form of apparatus.

In the apparatus of FIGS. 4 and 5, a bottom plate 30 is supported on a mounting (not shown) adapted to apply strong upward pressure to the plate as indicated by arrows 31, the plate having two or more longitudinally disposed channels 32, 32 in its upper face. The complementary upper plate 33 has similar channels 34 in its lower face and is adapted to be reciprocated by suitable means (not shown) as indicated by the arrows 35 to lap, pressure grind or flash roll the batch of rolling elements 36 positioned in the channels 32, 34. The upward pressure applied to the plate and rolling element assembly is resisted by a series of heavy back-up rollers 37 mounted in a fixed part 38 of the machine.

The reciprocating type of lapping, pressure grinding or flash roll apparatus, described above, gives excellent results with low quality batches of rolling elements but superior quality can be obtained by means of the through-feed apparatus of FIGS. 8, 9, 10, 11 and 12. In such apparatus the bottom plate 40 is elongated to any convenient extent and is channeled in cross-section, like the plates 20, 30. A series of similarly channeled upper plates 41 is mounted on an endless conveyor 42 (comparable to a "tank track") carried on wheels 43, driven by a suitable driving means (not shown), the lower run of the plates passing under pressure or back-up rollers 44–48. The rolling elements 50 to be lapped, pressure ground or flash rolled are fed along the channels in the plate 40, as indicated by arrow 51, into the "nip" where they are engaged by the channels of the upper plates 41, successively, and are rolled along to the point of discharge 52. From this point the rolling elements may be removed, if finished, or may be returned by a simple conveyor (not shown) to the inlet end of the machine for recycling as many times as necessary.

Figure 9:
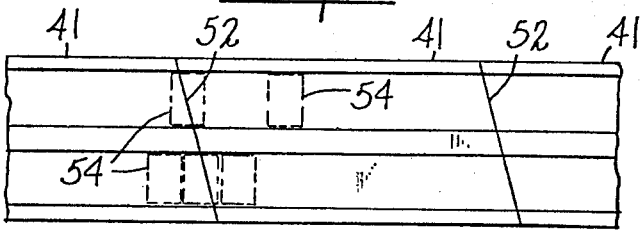
FIG. 9 represents a detail top plan view of the plates in FIG. 8 at the area indicated by arrows 9—9.

The pressure on applied rolling elements 50 in the working zone can be appliied either through the rollers 44–48, in any suitable manner, or by applying upward pressure to the plate 40, as in FIG. 4, the rollers 44–48 then acting as back-up rollers. In manufacturing flawless or near flawless quality rolling elements the pressure should be graduated so that the rolling elements entering the working zone under the first wheel 43 and roller 44 are subjected to relatively low pressure, thus avoiding danger of skewing or slipping, while the pressure progressively increases in the areas under rollers 45, 46, 47 and 48. The plates 41 may be rectangular or non-rectangular, e.g., rhomboidal, in plan view; in the latter case the forward and rear edges of adjacent plates in the series (particularly in the working zone) form seams which are angled at less than 90° with respect to the length of the channels. The angle may suitably be between 60° and 30°. Thus the rolling elements pass readily along the line of plates, the line of contact of each rolling element with the base of the channel intersecting the seam between plates only at a single point in any relative position of the rolling element and the seam. This is illustrated in FIG. 9, showing plates 41 inverted at the top of the machine, the angled ends of the plates being indicated at 53 and a few rolling elements 54 being shown in broken lines merely as an exmple of how rolling elements 50, in the working zone, can roll smoothly past each seam formed by the ends of adjacent plates. The angled plate edges, at the base of each channel, may be slightly beveled so that the rolling elements may traverse more smoothly from plate to plate. Such beveling of the edges also reduces the danger of injury to the plates by cracking or chipping.

Figure 10:
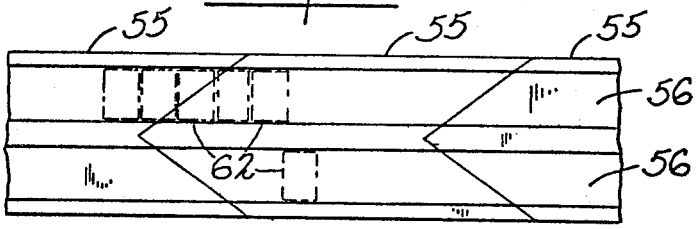
FIGS. 10 and 11 represent views similar to FIG. 9 showing plates having different shapes in plan view.
Figure 11:
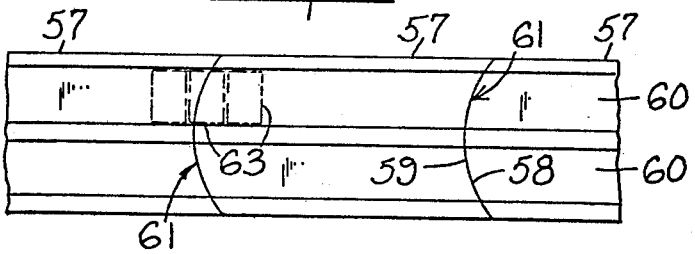

The movable plates may be made in other shapes, as shown in FIGS. 10 and 11, each having the advantage of rendering the plates self-aligning while still providing angled seams across the bases of the channels. In FIG. 10 the front and rear ends of the plates 55 are V-shaped, each end surface lying at about a 45° angle to the path of travel of the rolling elements 62 and plates 55 and two longitudinal tracks 56, 56 being provided, as in FIG. 9. In FIG. 11 the front and rear ends of the plates 57 are arcuate, the convex end 58 of one plate fitting closely into the concave end 59 of the adjacent plate. The two tracks 60, 60 lie on each side of a center line so that the seams 61 between adjacent ends lie at varying angles, less than 90°, to the line of travel of the rolling elements 63 and plates 57. FIGS. 10 and 11 are, like FIG. 9, diagrammatic to the extent that the rolling elements 62 and 63 are not actually found on the top of the machine (position 9—9) but are shown in broken lines in these figures to illustrate how they lie in relation to the angled seams between plates, in the working zone at the bottom of the machine.

Figure 8:
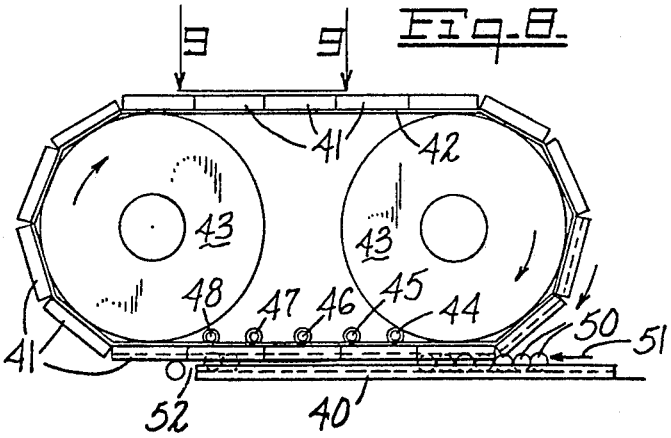
FIG. 8 represents a somewhat diagrammatic side elevation of a through-feed apparatus.
Figure 6:
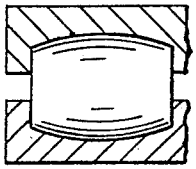
FIGS. 6 and 7 represent detail cross-sectional views showing the profiles of channels designed for lapping, pressure grinding or flash rolling of barrel and spherical rolling elements, respectively.
Figure 7:
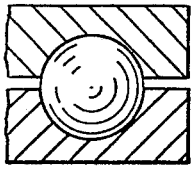
Figure 8A:
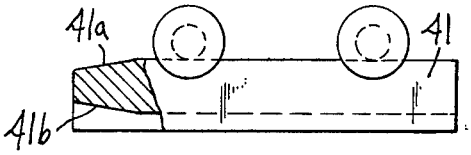
FIG. 8A represents a side elevation on a larger scale of one of the plates of FIG. 8.

If rectangular plates are used they should be slightly beveled toward their forward upper edges as indicated at 41*a* in FIG. 8A, to enable each plate to exert graduated pressure on the rolling elements and to facilitate easy passage of successive plates under the array of pressure rolls. Forward upper edges of non-rectangular plates may be similarly beveled, for the same purposes, and forward working edges 41*b* should be beveled, additionally.

Figure 12:
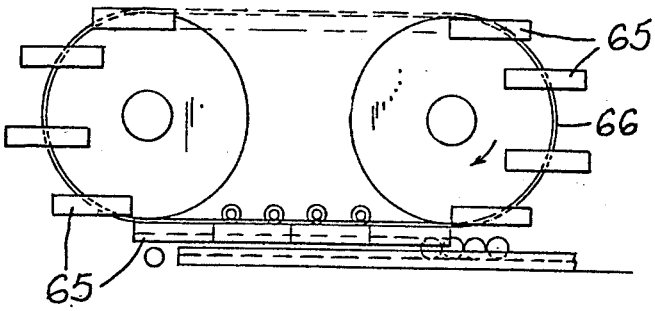
FIG. 12 represents a view similar to FIG. 8 illustrating the use of a modified form of plate conveyor.

Since a through-feed lapping, pressure grinding or flash roll apparatus requires only that the separate (upper) plates be returned in sequence from the discharge end to the inlet end, other forms of plate conveyor could be used. FIG. 12 shows a "Ferris wheel" type of conveyor in which the plates 65 are hung from a track 66 so that their channeled faces remain facing downward at all times. The return run of the plates could also be spaced laterally from the working zone instead of above it.

A Ferris wheel conveyor or lateral conveyance method would be especially useful where coarse lapping or grinding abrasives might lap or otherwise damage the conveyor linkage of a conveyor as shown in FIG. 8. Any such excessive wear factor arising from abrasive material in the conveyor would tend to cause looseness and maladjustment, increasing the downtime and maintenance problems.

The simplicity of the through-feed apparatus assures a minimal possibility of quality rejections. Grind cuts, grind burns and re-hardneed areas cannot occur. Micro-cavities in the finished product are leveled off, smoothed out so that the contour of the rolling element is free of such cavities. Machine cuts cannot occur since the tooling has no sharp or jagged edges and chatter marks from dull tooling cannot occur.

Every rolling element in a mass quantity lot is assured of traveling the same distance through the set-up per pass; a minimum size variation (down to millionths of an inch) can thus be assured. The rolling elements (other than balls) are received in the tracks with their axes perpendicular to the direction of movement, which is also the direction of least resistance to rolling of said elements.

The lapping, pressure grinding or flash roll plates may consist of cast iron, abrasive mixtures (such as an abrasive stone), abrasive compounds or any other material of metallic consistency. Abrasive lapping, pressure grinding or flash roll plates may be encased in a chuck which may be bowed slightly, in its longitudinal vertical plane, to be downwardly convex, the lapping plate being correspondingly contoured. Such shaping of the chuck and lapping plate is a form of pre-stressing which will distribute effectively the working stresses within the lapping plate. This design also results in the equivalent of a bevel at the forward working edge, corresponding to bevel 41b (FIG. 8A). Good lapping can be achieved by the use of relatively soft conventional lapping plates, which are compressed to a greater density by the pressure rolls but spring back to normal density when pressure is relieved.

The lapping, pressure grinding or flash roll surfaces of all the plates within the same set-up should be substantially parallel to each other. The over-all positioning of this set-up, however, may be horizontal, vertical, diagonal or any other position.

If only one side of the lapping, pressure grinding or flash roll plate has rolling element channels or tracks, the linear axis or axes of the tracks should be parallel to the flat and even side of the lapping, pressure grinding or flash roll plate. Lapping, pressure grinding or flash roll plates with tracks on only one side may be used in the set-ups of either a pair of plates or a set of tandem plates. While the drawings show two parallel tracks, it will be understood that more than two could be provided, if desired. The depth of each track is normally less than half the diameter of the rolling elements.

If rolling element tracks are located on both sides of the lapping, pressure grinding or flash roll plate the axis of any two tracks on opposite sides should be parallel where any two sets of axial points of different tracks on opposite sides fall at the same position on the cross-sections of their respective tracks. Lapping, pressure grinding or flash roll plates with tracks on opposite sides would be most advantageous as medial plates in a tandem set-up, however, the design of such plates may be used in the set-up of a pair of plates.

The axial direction of each track should correspond to the direction of traverse. The axial length of the tracks is dependent upon the traverse distance and the number of anti-friction rolling elements to be placed in one track. This length should be greater than the sum of the diameters of all the rolling elements within one track. This is to allow for an unimpeded movement of rolling elements.

The cross-section dimension of each track will remain constant throughout the axis of each track. This dimension will also remain constant in each track throughout the set-up. Its size should be slightly larger than the axial length of the rolling elements being processed.

Each rolling element track should be spaced parallel and equidistant apart when more than one track is machined on the same side of a lapping, pressure grinding or flash roll plate.

In instances where uniform pressure is applied to the set-up the depth of each track should remain the same throughout a major portion of the lapping, pressure grinding or flash roll surfaces of each track. This depth will become greater as processing continues.

The cross-sections of the rolling element tracks of one lapping, pressure grinding or flash roll plate should align with the cross-sections of the rolling element tracks of another lapping, pressure grinding or flash roll plate when rolling elements are processed between the lapping, pressure grinding or flash roll plates.

All of the plates within a set-up may consist of similar or dissimilar materials. Example — one or more lapping plate of metallic consistency may be used in the same set-up with one or more pressure grinding plate of abrasive content or all of the plates may consist of similar or dissimilar metallic material or all of the plates may consist of similar or dissimilar abrasive materials.

The lapping, pressure grinding or flash roll plates may be slotted diagonally across the path of the traverse. These slots may be pre-machined at equidistant and parallel intervals on one or both sides of one or more lapping, pressure grinding or flash roll plates within the set-up. The purpose of the diagonal slots is three-fold;

a. The flow of the abrasive mixtures, abrasive compounds or coolant will be spread equally throughout the set-up.
b. The stock removal process will be increased.
c. Warpage of the lapping, pressure grinding or flash roll plates will be eliminated as a result of the slots. The diagonal slots will serve as an expansion joint against the intense build-up of friction.

The width of the diagonal slots should be uniform throughout the set-up.

The length of the linear axis of each diagonal slot may or may not be uniform throughout the set-up.

Control of the traversing distance of each lapping, pressure grinding or flash roll plate may be regulated by mechanical, electrical, hydraulic or pneumatic means, or by any combination of either. The distance of traverse is dependent on the O.D. dimension of the rolling element being processed and the rolling element specifications for roundness and surface finish.

As noted above, the present method and apparatus are adaptable to the conditioning of spherical rolling elements, as well as cylindrical, needle or barrel rollers, merely by interchanging the respective plates. Thus, a manufacturer of ball bearings can readily enter the roller bearing field, and vice versa.

The spacing and alignment of the rolling elements in a rectilinear fashion, as shown and described, makes possible the simultaneous processing of many more rolling elements than can be handled in other systems, thus greatly reducing manufacturing costs. This is particularly true with the tandem set-ups of FIGS. 1 to 3 for the "batch" operation. In the straight-through operation, depending upon the size of the machine and the size of the parts being processed, literally thousands of parts may be processed simultaneously. Although lapping is generally regarded as being a relatively inefficient abrasive process the greatly increased capability of processing large quantities simultaneously overcomes the initial disadvantages of a relatively time consuming cutting action.

EXAMPLE

Machine A is capable of processing a single part in one minute. The productive rate at which Machine A is operating is 1.0 minute per piece.

Machine B is less efficient in its cutting action. A single machine cycle is twice as lengthy but two parts are processed simultaneously. The productive rate which Machine B is operating is therefore equivalent to the productive rate of Machine A. Machine B is operating at a productive rate of 1.0 minute per piece.

Machine C is far less efficient in its cutting action than Machines A & B. A single machine cycle takes 100 minutes; however, 1000 parts are processed simultaneously throughout the machine cycle. As a result Machine C is the most efficient of the three machines since its productive rate is 0.1 minute per piece.

It should be noted also that systems utilizing rotating devices such as centerless grinding wheels have a built-in limitation on their speed of operation due to the centrifugal force factor. By the use of rectilinear motion, as disclosed herein, the processing speeds may be relatively high.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the general and specific features of the invention herein described, and all statements of the scope of the invention which, as a matter of language, might be said to fall therebetween.

What I claim is:

1. Apparatus for conditioning the rolling surfaces of rolling bearing elements comprising, at least two plates having facing complementary surfaces defining at least two opposite sides of a space corresponding to an axial cross-section of the rolling bearing elements to be conditioned, means for causing high speed relative rectilinear movement of said plates continuously in a single direction, at least one of said surfaces being formed with a profiled track extending in a direction substantially parallel to the direction of relative movement of the plates, means for applying pressure to at least one of said plates and means for supplying abrasive material to said surfaces.

2. Apparatus for conditioning the rolling surfaces of rolling bearing elements comprising, an elongated plate having on its upper surface at least one longitudinally disposed track, a plurality of plates having downwardly facing complementary tracks, said upwardly and downwardly facing tracks defining at least two opposite sides of a space corresponding to an axial cross-section of the rolling elements to be conditioned, means for conveying said plurality of plates continuously in a single direction along a path parallel to the elongated plate and longitudinal thereof, means for applying pressure to said plurality of plates, and means for supplying abrasive material to the rolling elements to be conditioned.

3. Apparatus according to claim 2 which includes a set of high load capacity rollers in operative relation to said plurality of plates.

4. Apparatus according to claim 2 wherein each of said plurality of plates is rhomboidal in plan.

5. Apparatus according to claim 2 wherein each of said plurality of plates has its ends complementarily V-shaped in plan.

6. Apparatus according to claim 2 wherein each of said plurality of plates has its ends complementarily arcuate in plan.

7. Apparatus according to claim 2 wherein each of said plurality of plates has its upper surface beveled to provide a reduced vertical dimension at its front edge.

8. Apparatus according to claim 2 wherein said conveying means includes at least one endless plate carrier and supports therefor.

9. Apparatus according to claim 8 wherein the pressure applying means includes a set of high load capacity rollers mounted in positions to bear against said plurality of plates when the tracks thereof are operatively opposite said one longitudinally disposed track.

10. Apparatus according to claim 1 wherein at least one of said plates is of relatively soft lapping plate material adapted to be compressed resiliently to a greater density by the passage of a rolling bearing element.

* * * * *